US011415347B2

(12) United States Patent
Goel et al.

(10) Patent No.: US 11,415,347 B2
(45) Date of Patent: Aug. 16, 2022

(54) METHOD AND APPARATUS FOR BALANCED FLUID DISTRIBUTION IN TANDEM-COMPRESSOR SYSTEMS

(71) Applicant: Lennox Industries Inc., Richardson, TX (US)

(72) Inventors: Rakesh Goel, Irving, TX (US); Siddarth Rajan, Dallas, TX (US); Patric Ananda Balan Thobias, Pondicherry (IN); Abdul Rehman, Chennai (IN)

(73) Assignee: Lennox Industries Inc., Richardson, TX (US)

( * ) Notice: Subject to any disclaimer, the term of this patent is extended or adjusted under 35 U.S.C. 154(b) by 485 days.

(21) Appl. No.: 16/679,662

(22) Filed: Nov. 11, 2019

(65) Prior Publication Data

US 2020/0072521 A1 Mar. 5, 2020

Related U.S. Application Data

(63) Continuation of application No. 15/464,606, filed on Mar. 21, 2017, now Pat. No. 10,495,365.

(51) Int. Cl.
*F25B 5/00* (2006.01)
*F25B 41/24* (2021.01)
(Continued)

(52) U.S. Cl.
CPC ..... *F25B 41/24* (2021.01); *F04B 41/06* (2013.01); *F04D 13/12* (2013.01); *F25B 31/00* (2013.01);
(Continued)

(58) Field of Classification Search
CPC ..... F25B 41/24; F25B 31/00; F25B 31/002; F25B 49/02; F25B 49/022;
(Continued)

(56) References Cited

U.S. PATENT DOCUMENTS 2,294,552 A 9/1942 Gygax
3,243,101 A 3/1966 Shaw
(Continued)

FOREIGN PATENT DOCUMENTS

CN 1465928 A 1/2004
EP 0403239 A2 12/1990
(Continued)

OTHER PUBLICATIONS

Danfoss scroll compressors SH—In parallel installation, https://assets.danfoss.com/documents/DOC230286438497/DOC230286438497.PDF (accessed Jul. 31, 2020) (Year: 2017).
(Continued)

*Primary Examiner* — Henry T Crenshaw
*Assistant Examiner* — Kamran Tavakoldavani
(74) *Attorney, Agent, or Firm* — Shackelford, Bowen, McKinley & Norton, LLP

(57) ABSTRACT

A compressor system includes a first compressor and a second compressor. A suction equalization line fluidly couples the first compressor and the second compressor. A first branch suction line is fluidly coupled to the first compressor and a second branch suction line is fluidly coupled to the second compressor. A main suction line is fluidly coupled to the first branch suction line and the second branch suction line. An obstruction device is disposed in at least one of the first branch suction line and the second branch suction line. Responsive to deactivation of at least one of the first compressor and the second compressor, the obstruction device is at least partially closed thereby causing prescribed liquid levels in the first compressor and the second compressor during partial-load operation.

20 Claims, 11 Drawing Sheets

(51) Int. Cl.

| | |
|---|---|
| ***F25B 49/02*** | (2006.01) |
| ***F25B 31/00*** | (2006.01) |
| ***F04D 13/12*** | (2006.01) |
| ***F04B 41/06*** | (2006.01) |

(52) U.S. Cl.
CPC ..... *F25B 49/02* (2013.01); *F25B 49/022* (2013.01); *F25B 31/002* (2013.01); *F25B 2400/075* (2013.01); *F25B 2400/0751* (2013.01); *F25B 2500/16* (2013.01); *F25B 2500/27* (2013.01); *F25B 2600/0251* (2013.01); *F25B 2600/2519* (2013.01)

(58) Field of Classification Search
CPC ..... F25B 2400/075; F25B 2400/0751; F25B 2500/16; F25B 2500/27; F25B 2600/0251; F25B 2600/2519; F25B 1/10; F25B 41/12; F25B 2400/07; F04B 41/06; F04D 13/12
See application file for complete search history.

(56) References Cited

U.S. PATENT DOCUMENTS

| | | | |
|---|---|---|---|
| 3,386,262 | A | 6/1968 | Hackbart et al. |
| 3,785,169 | A | 1/1974 | Gylland, Jr. |
| 4,102,149 | A | 7/1978 | Conley et al. |
| 4,141,676 | A | 2/1979 | Jannen et al. |
| 4,269,261 | A | 5/1981 | Kountz et al. |
| 4,383,802 | A | 5/1983 | Gianni et al. |
| 4,418,548 | A | 12/1983 | Sawyer |
| 4,551,989 | A | 11/1985 | Lindahl et al. |
| 4,729,228 | A | 3/1988 | Johnsen |
| 4,741,674 | A | 5/1988 | Tischer |
| 4,750,337 | A | 6/1988 | Glamm |
| 5,094,598 | A | 3/1992 | Amata et al. |
| 6,186,758 | B1 | 2/2001 | Shaw |
| 6,722,143 | B2 | 4/2004 | Moon et al. |
| 6,928,828 | B1 | 8/2005 | Taras et al. |
| 6,948,916 | B2 | 9/2005 | Hebert |
| 7,325,414 | B2 | 2/2008 | Taras et al. |
| 7,469,555 | B2 | 12/2008 | Taras et al. |
| 7,651,322 | B2 | 1/2010 | Shaw |
| 8,215,122 | B2 | 7/2012 | Hyun et al. |
| 8,408,024 | B2 | 4/2013 | Ogata et al. |
| 8,641,395 | B2 | 2/2014 | Nemit, Jr. |
| 9,551,351 | B2 | 1/2017 | De Bernardi et al. |
| 9,599,118 | B2 | 3/2017 | Zhou et al. |
| 10,634,137 | B2 * | 4/2020 | Fraser ..... F04C 28/02 |
| 2003/0230098 | A1 | 12/2003 | Moon et al. |
| 2003/0230099 | A1 | 12/2003 | Moon et al. |
| 2005/0091998 | A1 | 5/2005 | Cho et al. |
| 2006/0225445 | A1 | 10/2006 | Lifson et al. |
| 2018/0274835 | A1 | 9/2018 | Goel et al. |

FOREIGN PATENT DOCUMENTS

| | | | |
|---|---|---|---|
| EP | 1120611 | A1 | 8/2001 |
| WO | WO-2012080611 | A | 6/2012 |
| WO | WO-2013004972 | A1 | 1/2013 |

OTHER PUBLICATIONS

U.S. Appl. No. 15/464,470, Thobias et al.
U.S. Appl. No. 15/464,606, Goel et al.
U.S. Appl. No. 15/671,243, Berg, et al.
U.S. Appl. No. 15/606,571, Goel, et al.
U.S. Appl. No. 15/824,060, Goel, et al.

* cited by examiner

CALROOM TEST DATA RESULTS

CALROOM TEST DATA RESULTS

METHOD AND APPARATUS FOR BALANCED FLUID DISTRIBUTION IN TANDEM-COMPRESSOR SYSTEMS

CROSS-REFERENCE TO RELATED APPLICATIONS

This patent application is a continuation of U.S. patent application Ser. No. 15/464,606, filed on Mar. 21, 2017. U.S. patent application Ser. No. 15/464,606 incorporates by reference for any purpose the entire disclosure of U.S. patent application Ser. No. 15/464,470, filed on Mar. 21, 2017. U.S. patent application Ser. No. 15/464,606 and U.S. patent application Ser. No. 15/464,470 are incorporated herein by reference.

TECHNICAL FIELD

The present invention relates primarily to heating, ventilation, and air conditioning ("HVAC") systems and more particularly, but not by way of limitation, to HVAC systems having tandem compressors with balanced fluid flow between the compressors during partial load conditions.

BACKGROUND

Compressor systems are commonly utilized in HVAC applications. Many HVAC applications utilize compressor systems that comprise two or more parallel-connected compressors. Such multi-compressor systems allow an HVAC system to operate over a larger capacity than systems utilizing a single compressor. Frequently, however, multi-compressor systems are impacted by disproportionate fluid distribution between the compressors. Such disproportionate fluid distribution results in inadequate lubrication, loss of performance, and a reduction of useful life of the individual compressors in the multi-compressor system. Many present designs utilize mechanical devices, such as flow restrictors, to regulate fluid flow to each compressor. However, these mechanical devices are subject to wear and increased expense due to maintenance.

SUMMARY

The present invention relates primarily to heating, ventilation, and air conditioning ("HVAC") systems and more particularly, but not by way of limitation, to HVAC systems having tandem compressors with balanced fluid flow between the compressors during partial load conditions. In one aspect, the present invention relates to a compressor system. The compressor system includes a first compressor and a second compressor. A suction equalization line fluidly couples the first compressor and the second compressor. A first branch suction line is fluidly coupled to the first compressor and a second branch suction line is fluidly coupled to the second compressor. A main suction line is fluidly coupled to the first branch suction line and the second branch suction line. An obstruction device is disposed in at least one of the first branch suction line and the second branch suction line. Responsive to deactivation of at least one of the first compressor and the second compressor, the obstruction device is at least partially closed thereby causing prescribed liquid levels in the first compressor and the second compressor during partial-load operation.

In another aspect, the present invention relates to a method of establishing prescribed liquid levels in a multiple compressor system during partial-load operation. The method includes utilizing the multiple compressor system in partial-load operation such that at least one compressor of the multiple compressor system is de-activated. Fluid flow into the at least one compressor that is de-activated is restricted. Prescribed liquid levels in the compressors of the multiple compressor system are established during partial-load operation.

In another aspect, the present invention relates to a method of method of establishing prescribed liquid levels in a multiple compressor system during partial-load operation. The method includes determining partial-load conditions that result in unbalanced fluid flow to at least one compressor of the multiple compressor system. A suction equalization line is configured such that a suction pressure differential between individual compressors in the multiple compressor system is reduced. Prescribed liquid levels in the compressors of the multiple compressor system are established during partial-load operation.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
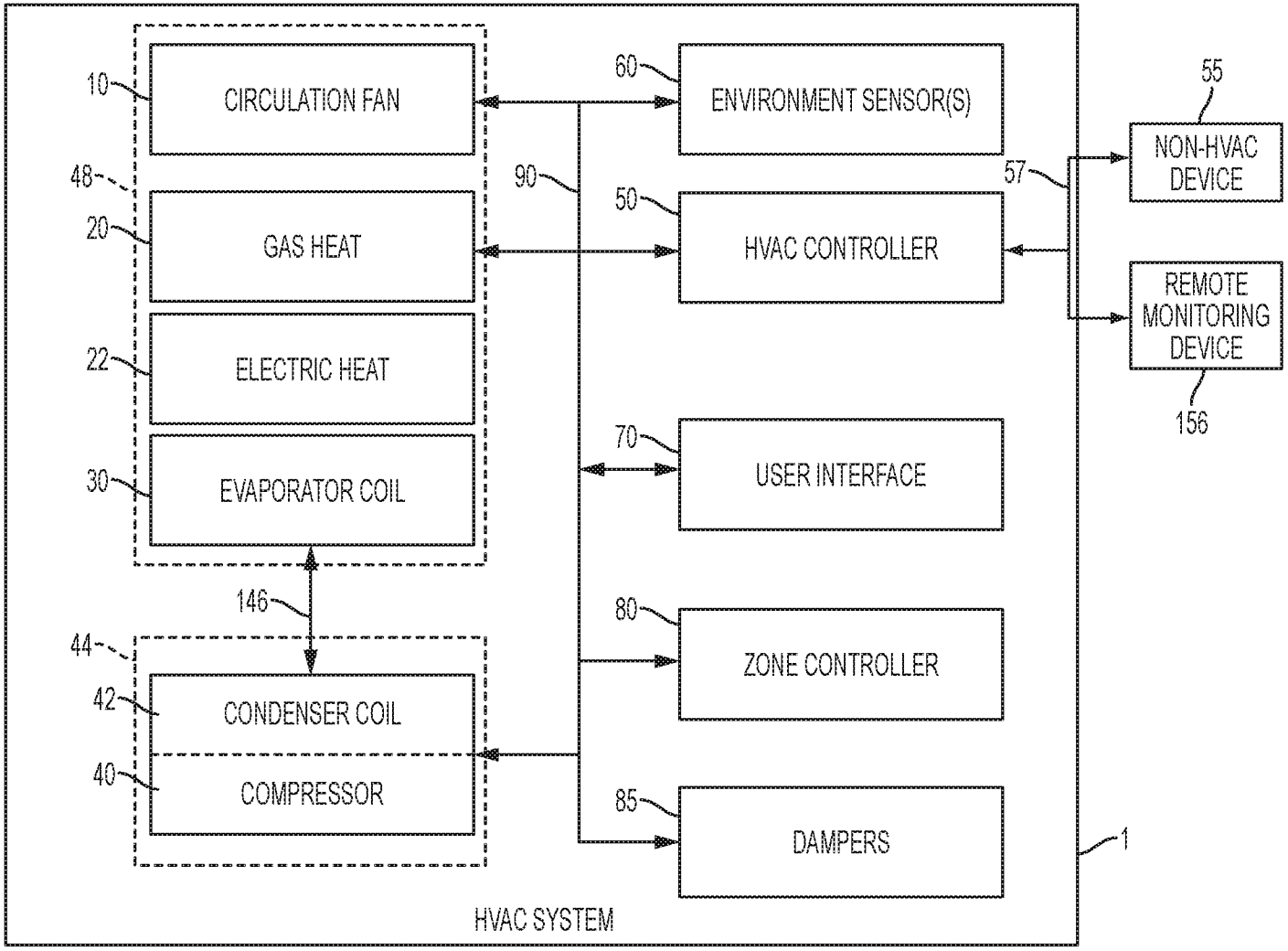
FIG. 1A is a block diagram of an HVAC system.

FIG. 1A illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1A includes various components; however, in other embodiments, the HVAC system 1 may include additional components that are not illustrated but typically included within HVAC systems.

The HVAC system 1 includes a variable-speed circulation fan 10, a gas heat 20, electric heat 22 typically associated with the variable-speed circulation fan 10, and a refrigerant evaporator coil 30, also typically associated with the variable-speed circulation fan 10. The variable-speed circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space. The HVAC system 1 also includes a variable-speed compressor 40 and an associated condenser coil 42, which are typically referred to as an "outdoor unit" 44. In various embodiments, the outdoor unit 44 is, for example, a rooftop unit or a ground-level unit. The variable-speed compressor 40 and the associated condenser coil 42 are connected to an associated evaporator coil 30 by a refrigerant line 46. In a typical embodiment, the variable-speed compressor 40 is, for example, a single-stage compressor, a multi-stage compressor, a single-speed compressor, or a variable-speed compressor. Also, as will be discussed in more detail below, in various embodiments, the variable-speed compressor 40 may be a compressor system including at least two compressors of the same or different capacities. The variable-speed circulation fan 10, sometimes referred to as a blower, is configured to operate at different capacities (i.e., variable motor speeds) to circulate air through the HVAC system 1, whereby the circulated air is conditioned and supplied to the enclosed space.

Still referring to FIG. 1A, the HVAC system 1 includes an HVAC controller 50 that is configured to control operation of the various components of the HVAC system 1 such as, for example, the variable-speed circulation fan 10, the gas heat 20, the electric heat 22, and the variable-speed compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the variable-speed circulation fan 10.

Still referring to FIG. 1A, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the variable-speed circulation fan 10 or the plurality of environment sensors 60.

Figure 1B:
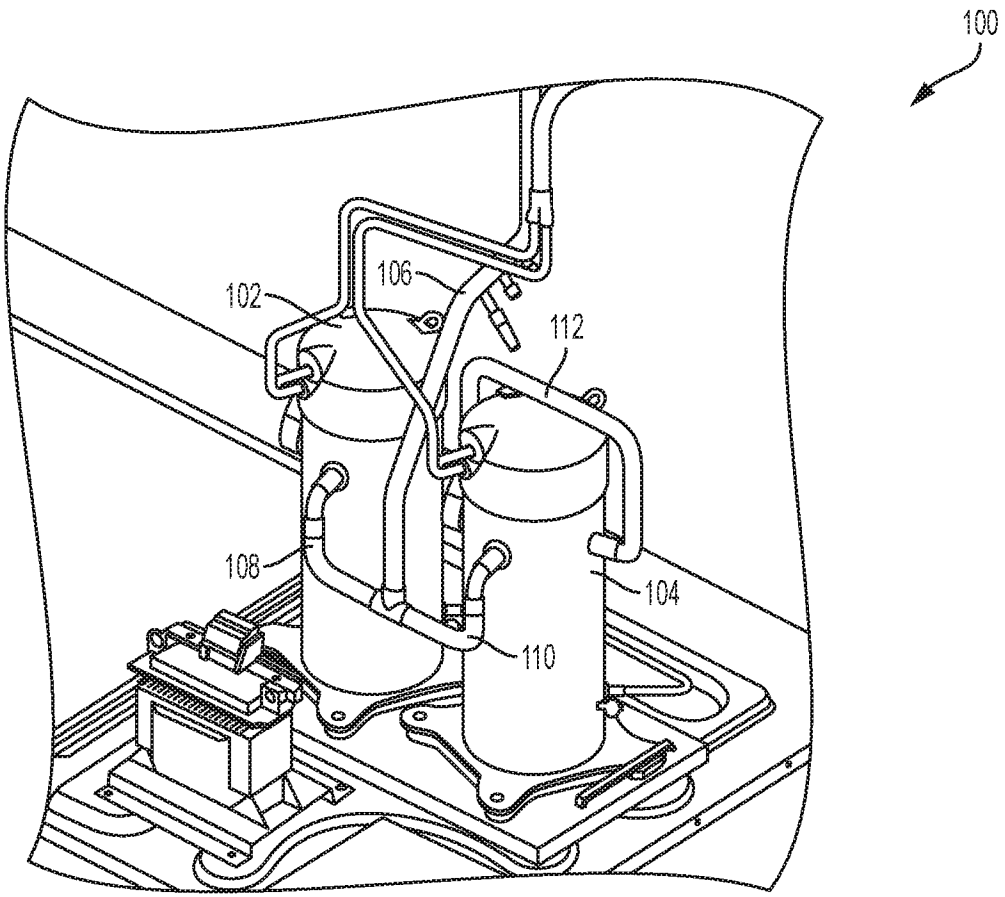
FIG. 1B is a schematic diagram of a current tandem compressor system.

FIG. 1B is a schematic diagram of a current tandem compressor system 100. The tandem compressor system 100 includes a first compressor 102 and a second compressor 104. A suction equalization line 112 is fluidly coupled to the first compressor 102 and the second compressor 104. A first branch suction line 108 is coupled to the first compressor 102 and a second branch suction line 110 is coupled to the second compressor 104. The first branch suction line 108 and the second branch suction line 110 are each fluidly coupled to a main suction line 106. During full-load operation, both the first compressor 102 and the second compressor 104 are operating. In this scenario, the tandem compressor system 100 exhibits a suction pressure differential between the first compressor 102 and the second compressor 104 that results in the prescribed liquid level in the first compressor 102 and the second compressor 104 being maintained. In a typical embodiment, the prescribed liquid level is a factory-specified parameter for a particular compressor.

Figure 1C:
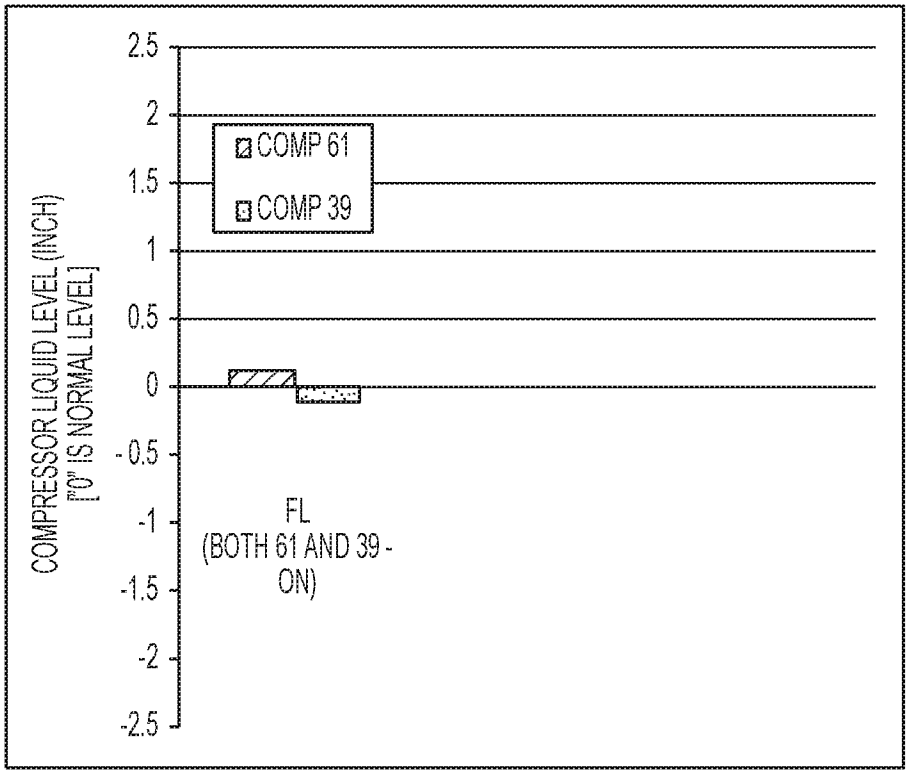
FIG. 1C is a table illustrating liquid levels in the compressor system of FIG. 1B during full load conditions.
Figure 1D:
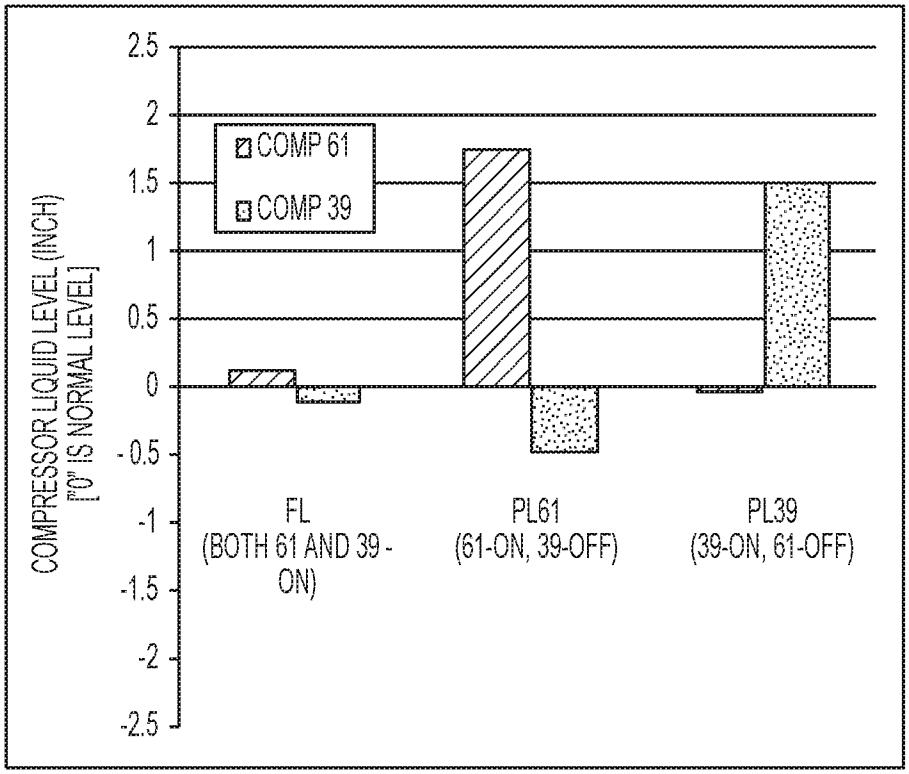
FIG. 1D is a table illustrating liquid levels in the compressor system of FIG. 1B during partial load conditions.

FIG. 1C is a chart illustrating liquid levels in the compressor system 100 during full load conditions. For purposes of illustration, FIG. 1C is discussed herein relative to FIG. 1B. By way of example, FIGS. 1C-1D illustrate a situation where the first compressor 102 and the second compressor 104 have unequal capacities; however, in other embodiment, the first compressor 102 and the second compressor 104 could have equal capacities. As shown in FIG. 1C, during full-load operation, the liquid level in the first compressor 102 and the second compressor 104 is close to a normal level, which is labeled as "0" in FIG. 1C. FIG. 1D is a table illustrating liquid levels in the compressor system 100 during partial load conditions. For purposes of illustration, FIG. 1D is discussed herein relative to FIG. 1B. During partial-load operation, at least one of the first compressor 102 and the second compressor 104 is de-activated. De-activation of at least one of the first compressor 102 and the second compressor 104 disturbs the pressure balance between the first compressor 102 and the second compressor 104 that exists during full-load operation. As shown in FIG. 1D, during partial-load operation, the liquid level in at least one of the first compressor 102 and the second compressor 104 varies significantly from the normal liquid level. Such fluid imbalance between the first compressor 102 and the second compressor 104 can result in inadequate lubrication in one of the first compressor 102 and the second compressor 104. Inadequate lubrication results from a fraction of lubricant leaving a compressor with the refrigerant fluid and not returning to the compressor. Thus, fluid imbalance between compressors can also result in disproportionate lubricate distribution. Inadequate lubrication of compressors can adversely impact performance, efficiency, and lifespan of the first compressor 102 and the second compressor 104.

Figure 2A:
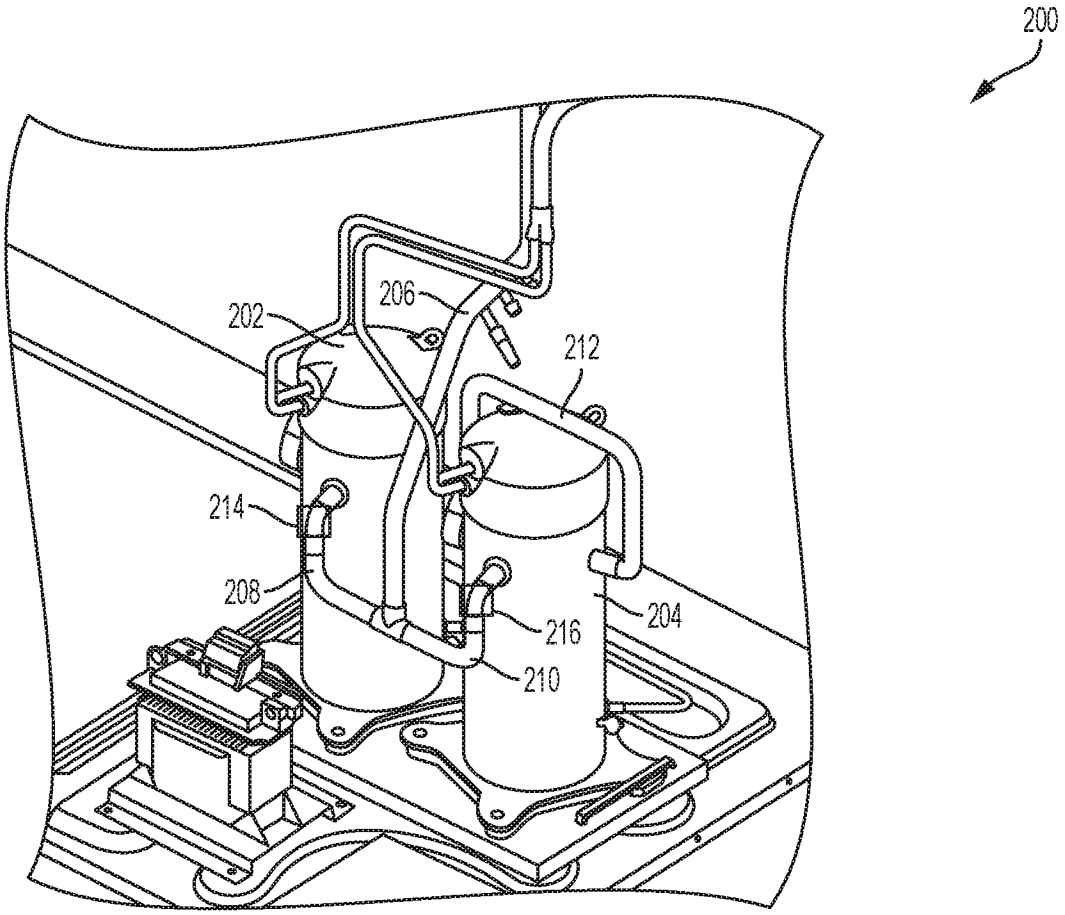
FIG. 2A is a schematic diagram of a tandem compressor system with branch cut-off valves according to an exemplary embodiment.

FIG. 2A is a schematic diagram of a tandem compressor system 200 with branch cut-off valves 214 and 216. The tandem compressor system 200 includes a first compressor 202 and a second compressor 204. In a typical embodiment, the first compressor 202 and the second compressor 204 are of unequal capacities; however, in other embodiments, tandem compressor systems utilizing principles of the invention may utilize compressors of approximately equal capacities. A main suction line 206 is disposed proximate the first compressor 202 and the second compressor 204. The main suction line 206 is then divided into a first branch suction line 208 and a second branch suction line 210. The first branch suction line 208 and the second branch suction line 210 are fluidly coupled to the first compressor 202 and the second compressor 204, respectively. A suction equalization line 212 is fluidly coupled to the first compressor 202 and the second compressor 204.

Still referring to FIG. 2A, a first branch cut-off valve 214 is disposed in the first branch suction line 208 and a second branch cut-off valve 216 is disposed in the second branch suction line 210. In a typical embodiment, the first branch cut-off valve 214 and the second branch cut-off valve 216 are capable of full or partial occlusion of the first branch suction line 208 and the second branch suction line 210, respectively. During partial-load operation, the branch cut-off valve that corresponds to the de-activated compressor is closed, thereby preventing fluid flow into the de-activated compressor. Thus, if the first compressor 202 is deactivated, the first branch cut-off valve 214 is closed thereby preventing fluid flow through the first branch suction line 208 into the first compressor 202. In a typical embodiment, the first branch cut-off valve 214 is closed during the entire period that the first compressor 202 is de-activated. In other embodiments, the first branch cut-off valve 214 is closed for a period such as, for example, approximately 1 minute to approximately 3 minutes, before activating the first compressor 202. Activation of the first compressor 202 occurs, for example, when changing from partial-load operation to full-load operation or when switching compressors during partial-load operation. In a typical embodiment, the first branch cut-off valve 214 and the second branch cut-off valve 216 are closed any time the first compressor 202 and the second compressor 204, respectively, are de-activated. However, in other embodiments, the first branch cut-off valve 214 and the second branch cut-off valve 216 may be utilized in an identified worst-case or a preferred partial-load operation scheme. In a typical embodiment, the first branch cut-off valve 214 and the second branch cut-off valve 216 are biased in the open position. Such an arrangement preserves fluid flow to the first compressor 202 and the second compressor 204, respectively, in the event of malfunction of at least one of the first branch cut-off valve 214 and the second branch cut off valve 216. In various other embodiments, one of the first branch cut-off valve 214 and the second branch cut-off valve 216 is utilized and the other of the first branch cut-off valve 214 and the second branch cut-off valve 216 is omitted.

Figure 2B:
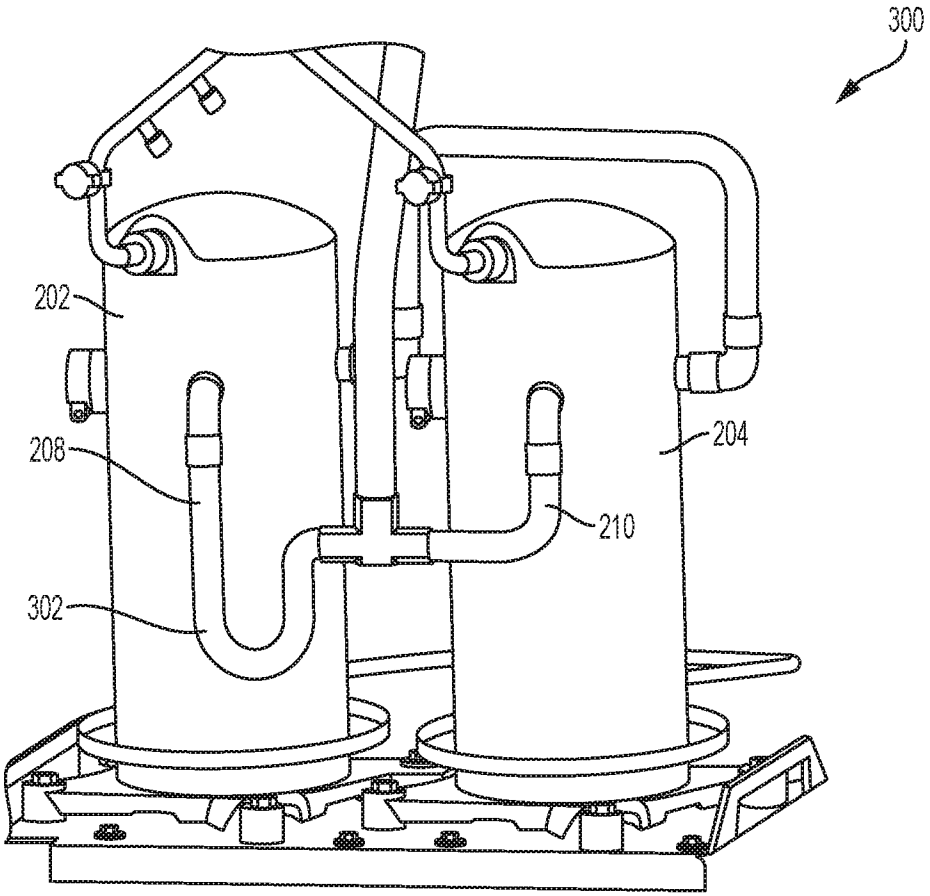
FIG. 2B is a schematic diagram of a tandem compressor system having a P-trap in accordance with an exemplary embodiment.

FIG. 2B is a schematic diagram of a tandem compressor system 300 having a P-trap 302. For purposes of illustration, FIG. 2B will be discussed herein relative to FIG. 2A. The tandem compressor system 300 is similar in construction and operation to the tandem compressor system 200 with the exception that the P-trap 302 is disposed in the first branch suction line 208. In other embodiments, the P-trap 302 may be disposed in the second branch suction line 210 or both the first branch suction line 208 and the second branch suction line 210. During partial-load operation, there is reduced flow in the branch suction line corresponding to the de-activated compressor. Thus, if the first compressor 202 is de-activated during partial-load operation, there is reduced flow in the first branch suction line 208. At low fluid-flow rates, fluid begins to accumulate in the P-trap 302. Accumulation of fluid in the P-trap 302 gradually restricts refrigerant flow through the first branch suction line 208 and reduces pressure drop across the first branch suction line 208. Reduction of the pressure drop across the first branch suction line 208 thereby reduces the liquid-level difference between the first compressor 202 and the second compressor 204.

Figure 2C:
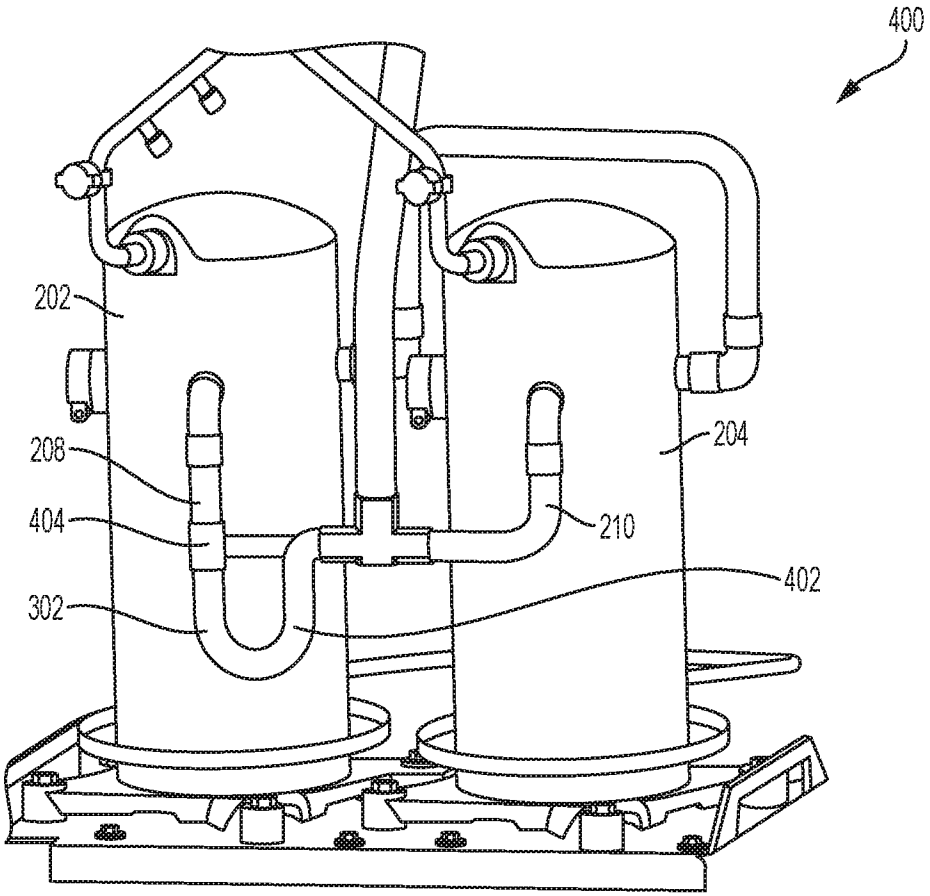
FIG. 2C is a schematic diagram of a tandem compressor system having a bypass P-trap in accordance with an exemplary embodiment.

FIG. 2C is a schematic diagram of a tandem compressor system 400 having a bypass P-trap 402. For purposes of illustration, FIG. 2C will be discussed herein relative to FIGS. 2A-2B. The tandem compressor system 400 is similar in construction and operation to the tandem compressor system 300 with the exception that the P-trap 402 includes a bypass flow path 404. In a typical embodiment, if the mass flow rate in the branch suction line 208 is greater than a threshold value (i.e. momentum of the fluid flow is greater than the P-trap 402 pressure drop, no reduction in pressure drop differential across the first branch suction line 208 and the second branch suction line 210 will occur because no trap has been formed. In order to reduce the mass flow rate, a bypass line 404 is created to facilitate formation of a trap. Due to inertia, most of the flow in the first branch suction line 208 flows through the bypass line 404 which reduces the momentum in the P-trap 402. Such reduction in fluid momentum causes accumulation of fluid in the P-trap 402 leading to reduction in the pressure drop differential across the first branch suction line 208 and the second branch suction line 210.

Figure 3:
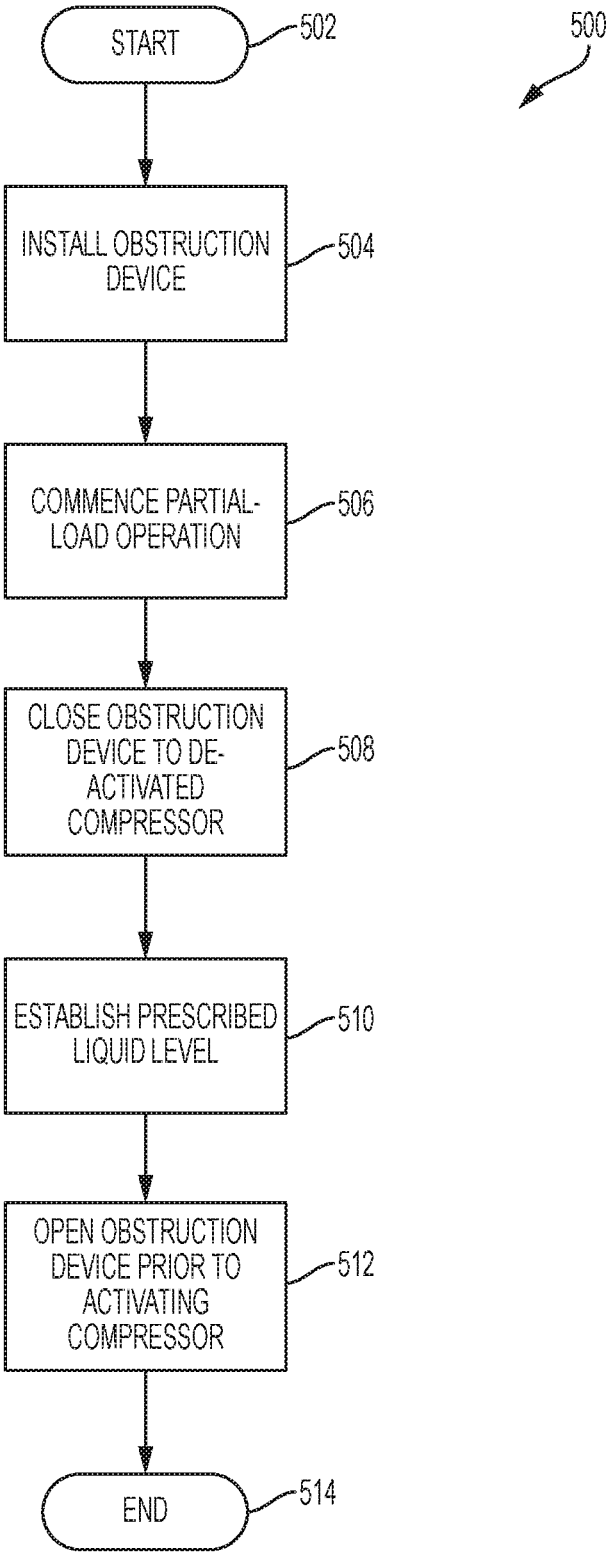
FIG. 3 is a flow diagram of a process for balancing fluid flow in a tandem compressor system during partial loading in accordance with an exemplary embodiment.

FIG. 3 is a flow diagram of a process 500 for balancing fluid flow in a tandem compressor system during partial loading. For purposes of illustration, FIG. 3 will be discussed herein relative to FIGS. 2A-2C. The process 500 begins at step 502. At step 504, an obstruction device is installed in at least one of the first branch suction line 208 and the second branch suction line 210. In a typical embodiment, the obstruction device could be, for example, a cut-off valve, a P-trap, or any other device capable of causing complete or partial obstruction of at least one of the first branch suction fine 208 and the second branch suction line 210. At step 506, the tandem-compressor system 200 is set to partial-load operation such that at least one of the first compressor 202 and the second compressor 204 are de-activated. At step 508 the obstruction device corresponding to the de-activated compressor is closed. At step 510, a suction pressure differential between the first compressor 102 and the second compressor 104 is balanced such that the prescribed liquid level in the first compressor 102 and the second compressor 104 is maintained. At step 512, the obstruction device valve is opened prior to activating the de-activated compressor. The process 500 ends at step 514.

Figure 4:
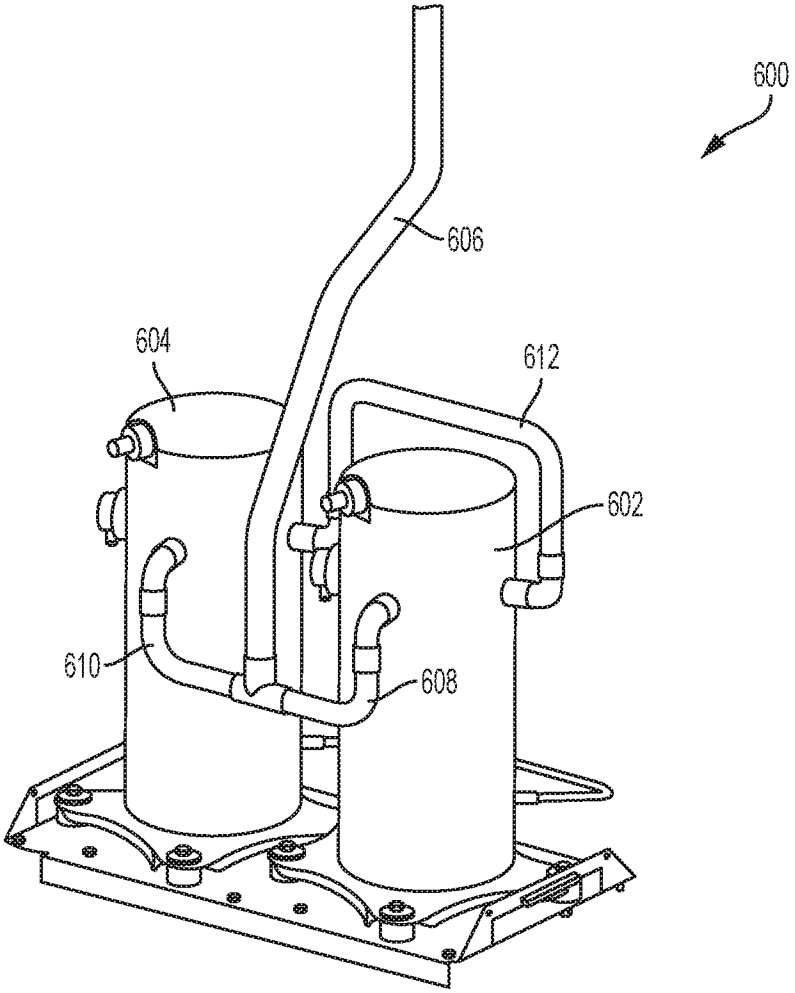
FIG. 4 is a schematic diagram of a tandem compressor system having a suction equalization line of increased diameter in accordance with an exemplary embodiment.

FIG. 4 is a schematic diagram of a tandem compressor system 600 having an optimized suction equalization line 612. For purposes of illustration, FIG. 4 will be discussed herein relative to FIGS. 2A-3. The tandem compressor system 600 includes a first compressor 602 and a second compressor 604. In a typical embodiment, the first compressor 602 and the second compressor 604 are of unequal capacities; however, in other embodiments, tandem compressor systems utilizing principles of the invention may utilize compressors of approximately equal capacities. A main suction line 606 (shown in FIG. 5) is disposed proximate the first compressor 602 and the second compressor 604. The main suction line 606 is then divided into a first branch suction line 608 and a second branch suction line 610. The first branch suction line 608 and the second branch suction line 610 are fluidly coupled to the first compressor 602 and the second compressor 604, respectively. A suction equalization line 612 is fluidly coupled to the first compressor 602 and the second compressor 604.

Still referring to FIG. 4, a diameter of the suction equalization line 612 is optimized to balance a suction pressure differential between the first compressor 602 and the second compressor 604. In general, it has been experimentally shown that a larger diameter of the suction equalization line 612 results in a lower suction pressure differential between the first compressor 602 and the second compressor 604. In a typical embodiment, the diameter of the suction equalization line 612 is proportional to a compressor refrigerant mass flow rate. A lower suction pressure differential between the first compressor 602 and the second compressor 604 causes a suction pressure differential between the first compressor 602 and the second compressor 604 to be balanced such that the prescribed liquid level in the first compressor 602 and the second compressor 604 is maintained. In a particular embodiment, for example, it was found that increasing the diameter of the suction equalization line 612 from ⅞" to 1⅛" resulted in a lower suction pressure differential and balanced fluid flow between the first compressor 602 and the second compressor 604.

Figure 5:
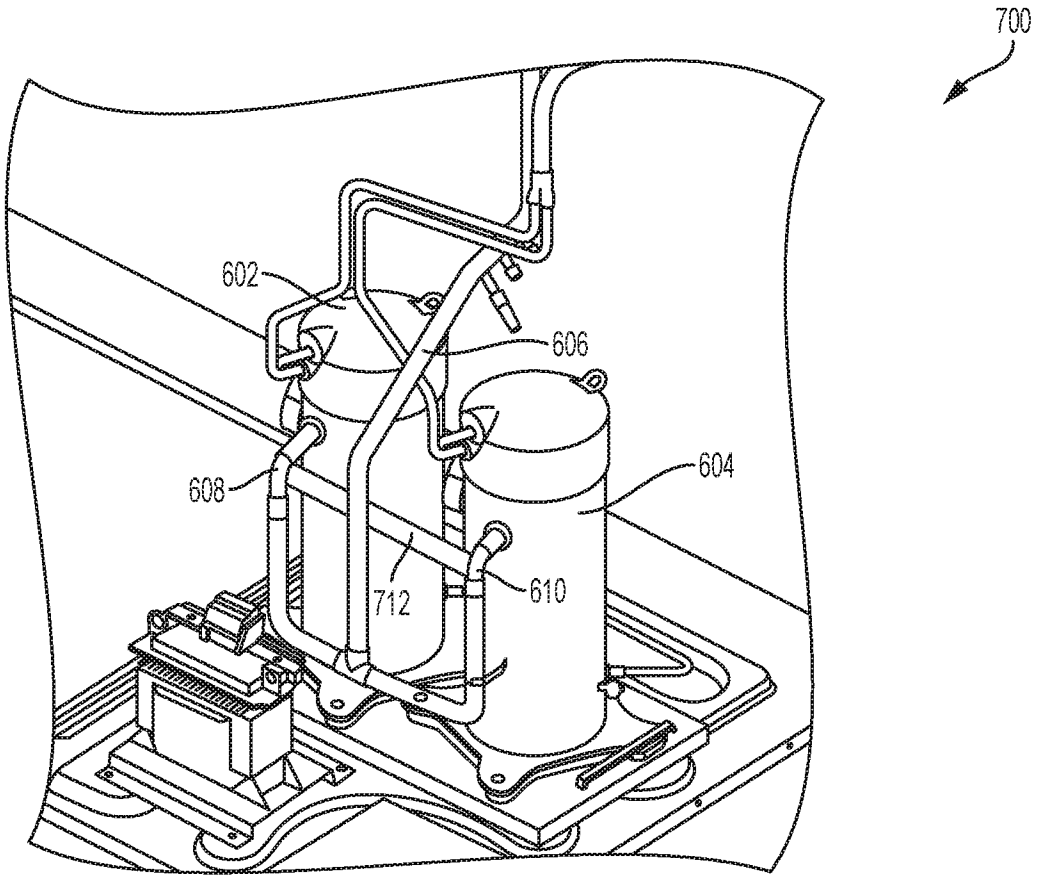
FIG. 5 is a schematic diagram of a tandem compressor system having relocated suction equalization line in accordance with an exemplary embodiment.

FIG. 5 is a schematic diagram of a tandem compressor system 700 having relocated suction equalization line 712. For purposes of illustration, FIG. 5 will be discussed herein relative to FIGS. 2A-4. The tandem compressor system 700 includes a suction equalization line 712 that is located between the first branch suction line 608 and the second branch suction line 610. The tandem compressor system 700 has the advantage of having all plumbing located on the same side of the first compressor 602 and the second compressor 604. Additionally, a diameter of the suction equalization line 712 is not limited by port diameters on the first compressor 602 and the second compressor 604. Also, the suction equalization line 712 is not dependent on internal flow resistance values of the first compressor 602 and the second compressor 604.

Figure 6:
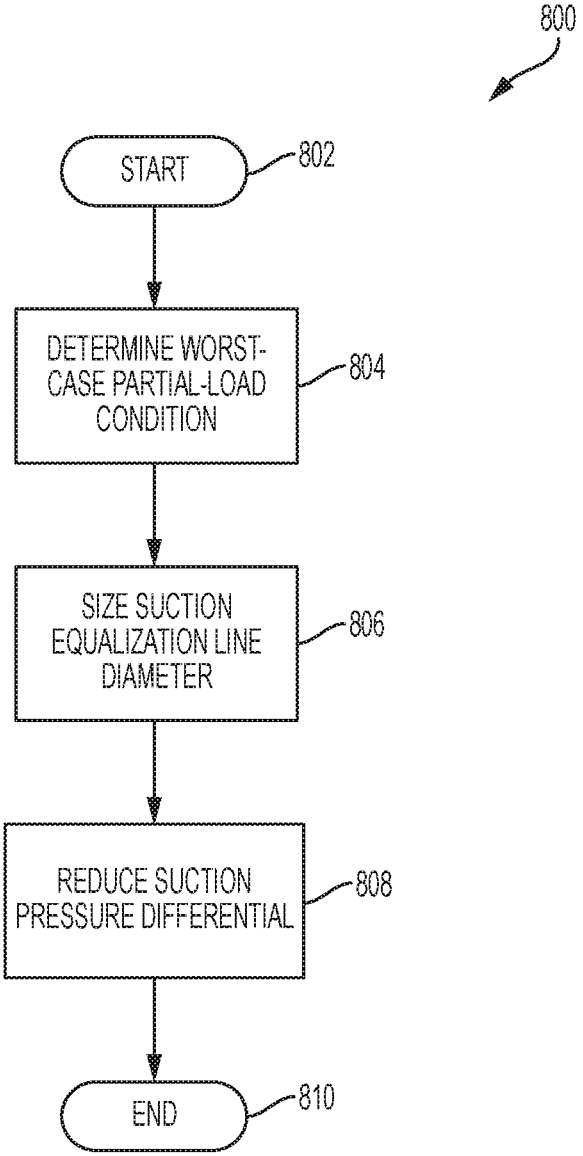
FIG. 6 is a flow diagram of a process for balancing fluid flow in a tandem compressor system during partial loading in accordance with an exemplary embodiment.

FIG. 6 is a flow diagram of a process 800 for balancing fluid flow in a tandem compressor system during partial loading. For purposes of illustration, FIG. 6 will be discussed herein relative to FIGS. 2A-5. The process 800 begins at step 802. At step 804, a worst-case partial load condition is determined. In a typical embodiment, the worst-case partial-load condition is a scenario where the larger of the first compressor 602 and the second compressor 604 is activated and the smaller of the first compressor 602 and the second compressor 604 is de-activated. At step 805, the first branch suction line 608 and the second branch suction line 610 are sized to be proportional the refrigerant mass flow rate of the first compressor 602 and the second compressor 604, respectively. At step 806, the suction equalization line 612 diameter is sized so that the suction pressure differential between the first compressor 602 and the second compressor 604 is less than or equal to 0.5" water column. In various embodiments, a larger suction equalization line diameter may be utilized to achieve lower suction pressure differentials. At step 808, a reduced suction pressure differential between the first compressor 602 and the second compressor 604 causes fluid flow to the first compressor and the second compressor 604 to be balanced during partial-load operation. The process 800 ends at step 810.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A multiple compressor system comprising:

a first compressor and a second compressor;

a suction equalization line fluidly coupling the first compressor and the second compressor;

a first branch suction line fluidly coupled to the first compressor;

a second branch suction line fluidly coupled to the second compressor;

a main suction line fluidly coupled to the first branch suction line and the second branch suction line;

an obstruction device disposed in at least one of the first branch suction line and the second branch suction line flow path, wherein the obstruction device comprises a P-trap having a bypass flow path; and wherein the obstruction device is partially closed responsive to deactivation of at least one of the first compressor and the second compressor thereby restricting fluid flow into at least one of the first compressor and the second compressor that is deactivated.

2. The multiple compressor system of claim 1, wherein the restricting fluid flow causes accumulation of fluid in the P-trap resulting in reduction in pressure drop differential across the a first branch suction line and the a second branch suction line.

3. The multiple compressor system of claim 1, wherein the obstruction device is capable of full and partial occlusion of at least one of the first branch suction line and the second branch suction line.

4. The multiple compressor system of claim 1, wherein the obstruction device is closed during an entire period that at least one of the first compressor and the second compressor is deactivated.

5. The multiple compressor system of claim 1, wherein the obstruction device is closed for a period of time prior to activation of at least one of the first compressor and the second compressor.

6. The multiple compressor system of claim 5, wherein the period of time is approximately 1 minute to approximately 3 minutes.

7. The multiple compressor system of claim 1, wherein a diameter of the first branch suction line and a diameter of the second branch suction line are sized relative to a capacity of the first compressor and the second compressor, respectively.

8. A multiple compressor system comprising:

a first compressor and a second compressor, wherein the multiple compressor system is configured to operate in partial-load operation responsive to deactivation of at least one of the first compressor and the second compressor;

a suction equalization line fluidly coupling the first compressor and the second compressor;

a first branch suction line fluidly coupled to the first compressor;

a second branch suction line fluidly coupled to the second compressor;

a main suction line fluidly coupled to the first branch suction line and the second branch suction line;

an obstruction device disposed in at least one of the first branch suction line and the second branch suction line flow path, wherein the obstruction device comprises a P-trap; and wherein the obstruction device is configured to restrict fluid flow into the at least one compressor that is de-activated and establish prescribed liquid levels in the compressors of the multiple compressor system during partial-load operation.

9. The multiple compressor system of claim 8, wherein the first compressor and the second compressor are of approximately equal capacity.

10. The multiple compressor system of claim 8, wherein a diameter of the first branch suction line and a diameter of the second branch suction line is optimized to be proportional to a compressor refrigerant mass flow rate.

11. The multiple compressor system of claim 8, wherein the obstruction device is capable of full and partial occlusion of at least one of the first branch suction line and the second branch suction line.

12. The multiple compressor system of claim 8, wherein the obstruction device is closed during an entire period that at least one of the first compressor and the second compressor is deactivated.

13. The multiple compressor system of claim 8, wherein the obstruction device is closed for a period of time prior to activation of at least one of the first compressor and the second compressor.

14. The multiple compressor system of claim 13, wherein the period of time is approximately 1 minute to approximately 3 minutes.

15. The multiple compressor system of claim 8, wherein a diameter of the first branch suction line and a diameter of the second branch suction line are sized relative to a capacity of the first compressor and the second compressor, respectively.

16. A method of establishing prescribed liquid levels in a multiple compressor system during partial-load operation, the method comprising:

utilizing the multiple compressor system in partial-load operation such that at least one compressor of the multiple compressor system is de-activated;

accumulating, in an obstruction device disposed in a branch suction line to at least one compressor, fluid during de-activation of the at least one compressor, wherein the obstruction device comprises a P-trap having a bypass flow path;

partially closing the obstruction device responsive to deactivation of the at least one compressor; and restricting fluid flow into the at east one compressor that is deactivated.

17. The method of claim 16, wherein the multiple compressor system comprises a first compressor and a second compressor.

18. The method of claim 17, wherein the first compressor and the second compressor are of approximately equal capacity.

19. The method of claim 16, wherein the obstruction device is closed for a period of time prior to activation of the at least one compressor.

20. The multiple compressor system of claim 19, wherein the period of time is approximately 1 minute to approximately 3 minutes.

* * * * *